US005105488A

United States Patent [19]

Hutchinson et al.

[11] Patent Number: 5,105,488

[45] Date of Patent: Apr. 21, 1992

[54] BEDDING CONFIGURATION HAVING VARIABLE SUPPORT CHARACTERISTICS

[75] Inventors: Ronald G. Hutchinson, Atlanta; Milton C. A. Callaway, Dahlonega, both of Ga.

[73] Assignee: Simmons Company, Atlanta, Ga.

[21] Appl. No.: 510,692

[22] Filed: Apr. 18, 1990

[51] Int. Cl.[5] ..... A47C 27/04; A47C 27/10

[52] U.S. Cl. ..... 5/464; 5/455; 5/477; 5/453; 5/614; 5/652

[58] Field of Search ..... 5/464, 453, 449, 455, 5/462, 470, 477, 475, 446, 447; 297/DIG. 3

[56] References Cited

U.S. PATENT DOCUMENTS

| | | | |
|---|---|---|---|
| 3,128,125 | 4/1964 | Loewy | 297/DIG. 3 |
| 3,303,518 | 2/1967 | Ingram | 5/453 |
| 3,872,525 | 3/1975 | Lea et al. | 5/450 |
| 3,877,092 | 4/1975 | Gaiser | 5/450 |
| 4,224,706 | 9/1980 | Young et al. | 5/455 |
| 4,245,363 | 1/1981 | Callaway | 5/477 |
| 4,306,322 | 12/1981 | Young et al. | 5/455 |
| 4,394,784 | 7/1983 | Swenson et al. | 5/455 |
| 4,462,129 | 7/1984 | Brannock | 5/464 |
| 4,589,695 | 5/1986 | Isono | 297/DIG. 3 |
| 4,679,264 | 7/1987 | Mollura | 5/455 |
| 4,686,722 | 8/1987 | Swart | 5/455 |
| 4,694,520 | 9/1987 | Paul et al. | 5/455 |
| 4,711,275 | 12/1987 | Ford et al. | 5/455 |
| 4,791,687 | 12/1988 | Iwase | 5/447 |
| 4,827,546 | 5/1989 | Cvetkovic | 5/449 |
| 4,924,541 | 5/1990 | Inagaki | 5/449 |

FOREIGN PATENT DOCUMENTS

| | | | |
|---|---|---|---|
| 555821 | 3/1957 | Belgium | 5/470 |
| 2394275 | 2/1979 | France | 5/446 |
| 1261475 | 1/1972 | United Kingdom | 5/455 |

*Primary Examiner*—Alexander Grosz
*Attorney, Agent, or Firm*—Jones Askew & Lunsford

[57] ABSTRACT

Bedding configurations are disclosed having supporting surfaces the firmness of which may be selectively adjustable by remote control means, providing for a supporting surface which may be quickly and easily adjusted by a user for maximum comfort. Various air chambers, cylinders, and tubes are disclosed for use in the central or "lumbar" portions of the mattresses of such bedding configurations, which may be selectively inflated or deflated in order to provide corresponding firmness levels. In a preferred embodiment a body support is comprised of an array of barrel-shaped coils that define elongate gaps at their top and bottom portions, with an elongate, inflatable tube positioned at least in the gaps defined in the top portion of the body support.

10 Claims, 5 Drawing Sheets

BEDDING CONFIGURATION HAVING VARIABLE SUPPORT CHARACTERISTICS

TECHNICAL FIELD

The present invention generally relates to bedding, and more particularly to bedding configurations having supporting surfaces the firmness of which may be selectively adjustable by remote control means, providing for a personalized supporting surface which may be quickly and easily adjusted by a user for maximum comfort.

BACKGROUND OF THE INVENTION

In bedding configurations, a need has been recognized for such configurations which provide comfortable supporting surfaces. However, different users of bedding configurations may have different concepts of comfort; one user may desire a less firm sleeping surface while another may desire a more firm surface. This problem is compounded when two different users, such as a husband and wife, have different bedding firmness preferences but wish to sleep in the same bed.

Difficulties can also arise if the same user has different bedding needs at different times, such as when that user's back pains prompt a need for a sleeping surface having a different firmness than the norm.

Therefore, it may be seen that a need exists for a bedding configuration which provides an improved supporting surface which may be adjustable to satisfy the various needs of its users, has improved wear characteristics, and is less likely to require periodic turning of the mattress.

SUMMARY OF THE INVENTION

The present invention provides an improvement over the prior art by providing an improved supporting surface which may be infinitely adjustable within a particular firmness range, and also may be adjusted to exhibit different firmnesses for each side of the bed.

Generally described, the present invention provides for a mattress configuration comprising a head region, a foot region, and a center region including an inflatable chamber, the chamber being selectively inflatable when in position within the mattress.

It is an object of the present invention to provide a bedding configuration having an improved supporting surface.

It is a further object of the present invention to provide a supporting surface which may be used by users having different firmness preferences.

It is a further object of the present invention to provide a supporting surface which may have different firmnesses in different areas.

It is a further object of the present invention to provide a supporting surface which may have different firmnesses at different periods in time.

It is a further object of the present invention to provide a supporting surface which may be adjustable by use of a remote control device.

It is a further object of the present invention to provide a supporting surface which may have different firmnesses on each side of the bed.

It is a further object of the present invention to provide a mattress which requires less turning due to improved wear characteristics.

Other objects, features, and advantages of the present invention will become apparent upon reading the following detailed description of the preferred embodiment of the invention when taken in conjunction with the drawings and the appended claims.

DETAILED DESCRIPTION OF THE PREFERRED EMBODIMENTS

First Preferred Embodiment

Figure 1:
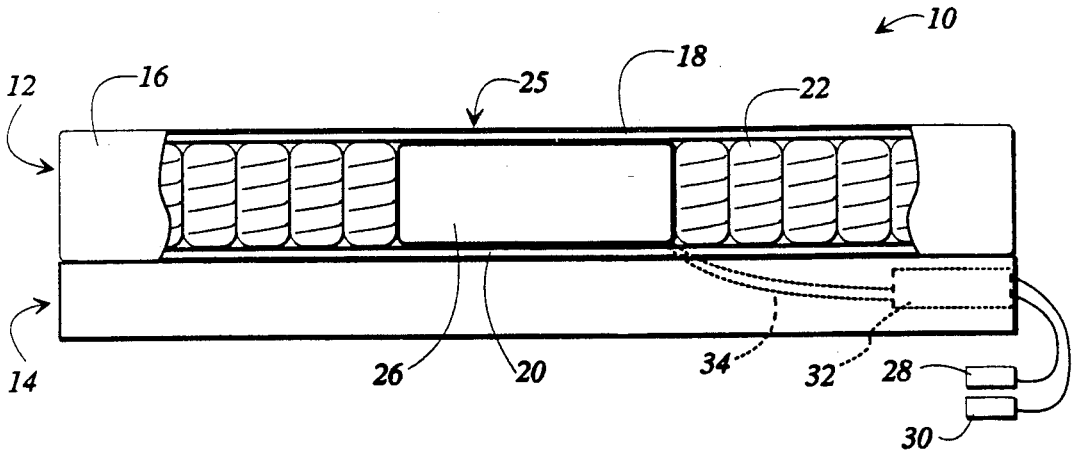
FIG. 1 is a side plan view of a first preferred embodiment of the invention, with a portion of the mattress shown in partial cutaway, and various concealed elements shown in dotted line.
Figure 2:
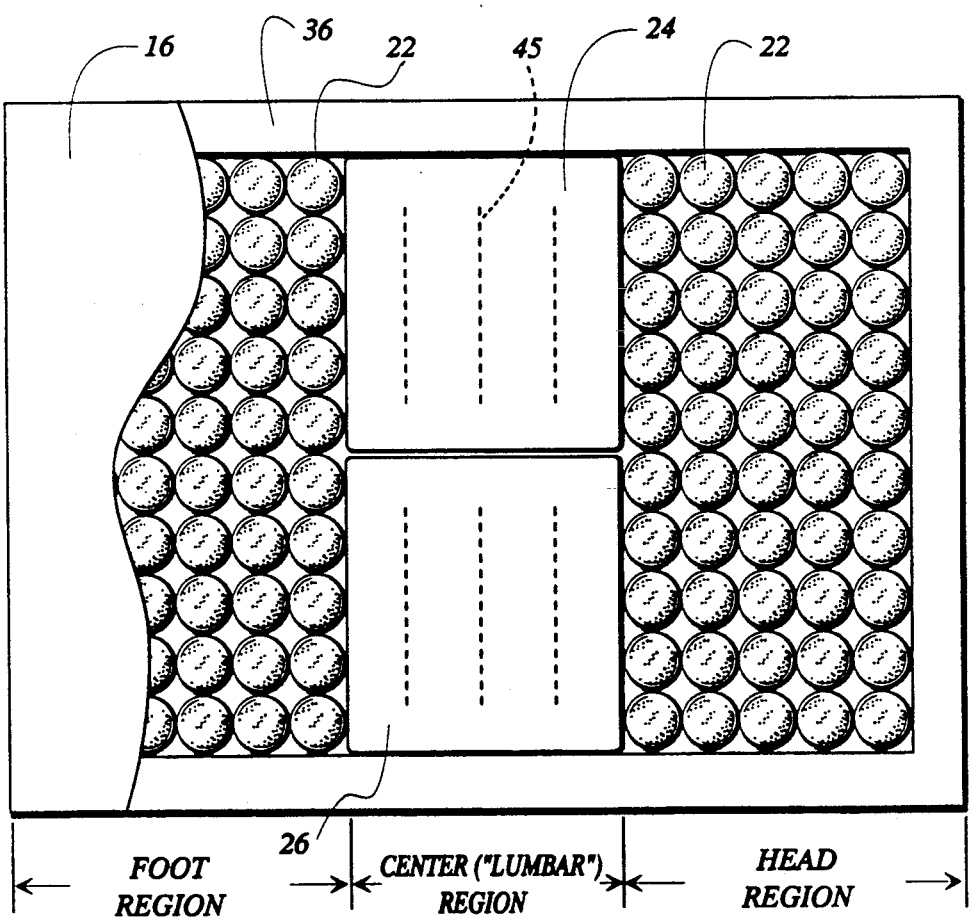
FIG. 2 is a top plan view of the mattress shown in FIG. 1, with a substantial portion of the fabric cover shown cut away to illustrate the interior features of the mattress.

Referring now to the drawings, in which like numerals represent like parts throughout the several views, FIGS. 1 and 2 illustrate a bedding system 10 including a mattress 12 situated atop a box spring 14. The mattress 12 includes a fabric cover 16, an upper padding layer 18, a lower padding layer 20, pocketed coils 22, a left side air chamber 24, and a right side air chamber 26. Also included are left and right-side remote control units 28, 30, respectively, an air pump 32, and air supply lines 34.

For purposes of this application, various references may be made to elements being "left" or "right" relative to other elements. The references "left" or "right" are made as if one is standing at the foot of the bed and viewing the bed. Of course, it should be understood that such terms "left" and "right" are merely relative as to the point of reference of the viewer.

As shown in FIG. 2, the mattress 12 and box spring 14 may be consider to have three "regions", a head region, a center or "lumbar" region, and a foot region. The head region and the foot region each include a plurality of pocketed coils 22. An example of such pocketed coils is illustrated in U.S. Pat. No. 4,234,983, entitled "THERMALLY WELDED SPRING POCKETS", hereby incorporated by reference, in which pocketed coil strings are provided, with individual springs formed between the overlaid plies of a two-ply strip of material by lines of separate individual thermal welds which connect the plies together.

The compression axis of the coils 22 are substantially coparallel and substantially normal to the upper supporting surface 25 of the mattress. The strings of pocketed coils may run longitudinally along the length of the mattress, or may alternately run transversely. The strings of coils may be fastened together into innerspring assemblies, if desired. An example is such innerspring assemblies is illustrated in U.S. Pat. No. 4,234,984, entitled "POCKETED SPRING ASSEMBLY" and U.S. Pat. No. 4,401,501, entitled "APPARATUS FOR MAKING ASSEMBLIES OF POCKETED SPRINGS", both hereby incorporated by reference, in which strips of pocketed upholstery springs are assembled, one strip at a time, into mattresses and the like. The connections of each such strip to its predecessor are made between the interpocket webs of the pocket sheeting of the two adjacent strips, preferably at intervals of two springs, and are staggered by one spring from strip to strip. Another type of innerspring construction is shown in U.S. Pat. No. 4,578,834, entitled "INNERSPRING CONSTRUCTION", hereby incorporated by reference, in which an innerspring construction including adhered strings of pocketed coil springs is disclosed together with a method of manufacture. The strings are connected to each other by an adhesive applied between the lines of tangency of adjacent coil springs. A hot melt adhesive applicator traverses a string of pocketed coils, depositing a precise amount of adhesive on each coil jacket. A second string is positioned on the first, and pressure is applied thereto. The applicator then traverses the second string in the same manner as the first. The sequence is repeated until an innerspring construction of desired size is created. U.S. Pat. No. 4,566,926, entitled "METHOD AND APPARATUS FOR MANUFACTURING INNERSPRING CONSTRUCTIONS", U.S. Pat. No. 4,578,834, discloses a method and apparatus for manufacturing the mattress assembly disclosed in U.S. Pat. No. 4,578,834.

Without departing from the spirit and scope of the present invention, the pocketed coils may not be fastened together, instead being packed sufficiently tight into the mattress interior to prevent misalignment or lateral movement.

Figure 9:
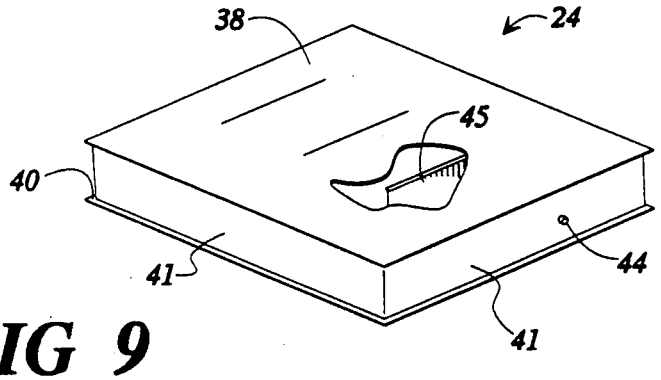
FIG. 9 is an isolated view of an air chamber used in the bedding configuration shown in FIGS. 1 and 2.

The "center" or "lumbar" portion of the mattress includes a left side air chamber 24 and a right side air chamber 26. The two chambers 24, 26 are similar in configuration and operation. Referring now only to FIG. 9, the left side air chamber 24 includes a top wall 38, a bottom wall 40, sides 41, and an air filler port 44. The air chamber 24 is configured to contain air provided through port 44, such that when air is inserted into the chamber 24 through port 44, it may be understood that the chamber is being "filled", whereas when air is withdrawn through the port 44, it may be understood that the chamber is being "deflated". Interior walls 45 are positioned within the cavity of the chamber and are attached to the upper and lower walls 38, 40, respectively, in order to reduce a disadvantageous "ballooning" effect which could cause the centers of the upper and lower walls 38, 40 to bulge outwardly. The chamber 24 is preferably made of vulcanized rubber, although other air-containing materials may be used without departing from the spirit and scope of the present invention.

Referring now again to FIGS. 1 and 2, the air supply lines 34 are attached to respective ports on each of the chambers 24, 26. These supply lines 34 allow for air communication between each of the air chambers 24, 26. Remote control units 28, 30, control the air pump as known in the art such that a user may selectively inflate or deflate each of the chambers 24, 26 by allowing air to pass from the air pump to the chambers, or vice versa.

The air pump 32 is preferably concealed within the box spring 14 although it could be positioned at a remote location for noise considerations. The air supply lines 34 are partially within the box spring 14 and partially within the mattress 12. The air supply lines pass through slits (not shown) in the mattress and box spring coverings, the slits being concealed as being at points of contact between the box spring and mattress. However, it should be understood that other configurations could be used without departing from the spirit and scope of the present invention. For example, the air supply tubes could extend through slits or grommeted holes at vertical walls at the head of both the mattress 12 and box spring 14, which would allow for easy inversion of the mattress 12 if desired, for reasons discussed below.

As seen from FIG. 1, the air chambers 24, 26 are covered by an upper padding layer 18 which is itself covered by a fabric layer 16. Therefore it may be seen that if a user sits, lies, or otherwise rests on the supporting surface above an air chamber, the air chamber will be compressed and will provide some support to the user's weight. As the air pressure is increased within the air chamber, it may be understood that the user will encounter a "firmer" supporting surface, that is, the sleeping surface will not deflect as much as it would if the air pressure within the chamber was less.

The location of the air chambers is one important part of the invention. It may be seen that the air chambers do not extend the length of the mattress, but instead are located at a location which is preferably at which the "lumbar" portion of the user's back will rest when in a prone resting position. This allows the center or "lumbar" portion of the mattress to be adjusted, while allowing the remainder of the mattress to exhibit characteristics similar to conventional bedding. Furthermore, the use of two chambers allows two persons lying side-by-side to control his or her lumbar portion of the mattress in a substantially independent manner.

This adjustability feature is another important part of the invention, as it may be seen that an infinite adjustability range may be achieved by use of suitable air pumps and flow control valves. It may also be understood that different air pump sizes may be used without departing from the spirit and scope of the present invention. Larger pumps may be used if a rapid air fill rate is desired, while smaller pumps may be used if quiet operation is desired.

As shown in FIG. 2, the bedding system 10 also includes a perimeter 36, which encircles the pocketed coils 22 and the air chambers 24, 26. The perimeter 36 may be of a foam construction, or may alternately be configured of one or more rows of pocketed coils, without departing from the spirit and scope of the present invention. Border wires (not shown), may also be provided in the perimeter 36 as known in the art, to provide structural integrity to the perimeter.

Therefore, it may be seen that the firmness of the supporting surfaces above the left and right side air chambers may be selectively and independently controlled by a user by use of the remote control units 28, 30, depending only upon that user's personal preferences. If a user on the left side of the bed desires alter the firmness of the lumbar portion of his/her side of the bed, the user need only operate the left side remote control unit. Preferably such operation will affect the firmness of the right side of the mattress to a minimum, although some effect may be had due to contact and resulting pressure between the two chambers. Such contact and pressure could be further minimized by the placement of a foam or other padding layer between the chambers (not shown).

Second Preferred Embodiment

Figure 3:
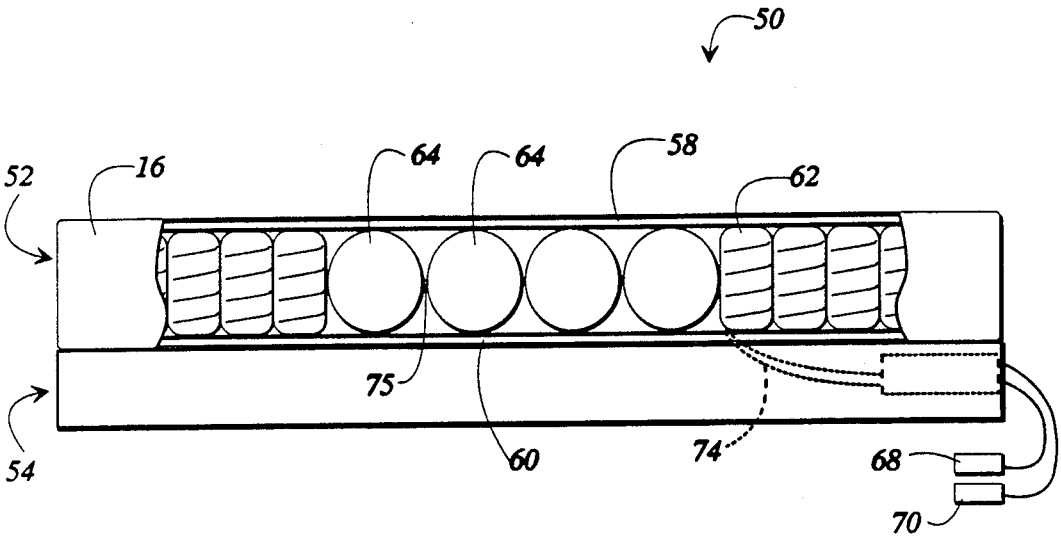
FIG. 3 is a side plan view of a second preferred embodiment of the invention, with a portion of the mattress shown in partial cutaway, and various concealed elements shown in dotted line.
Figure 4:
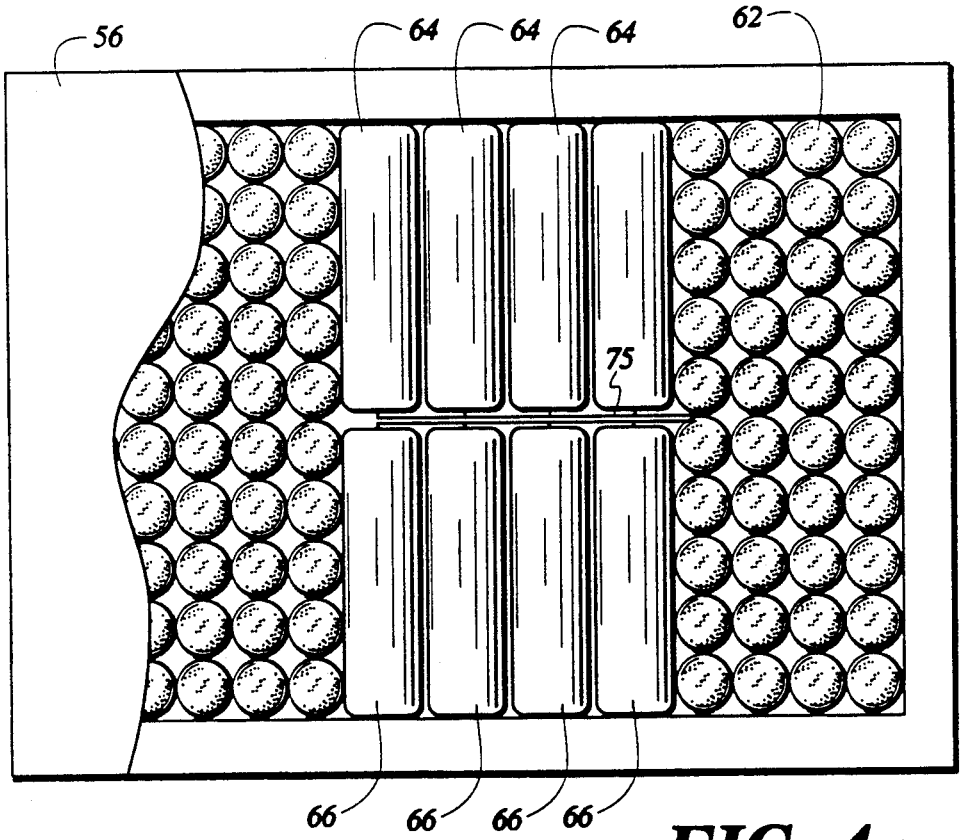
FIG. 4 is a top plan view of the mattress shown in FIG. 3, with a substantial portion of the fabric cover shown cut away to illustrate the interior features of the mattress.

Referring now to FIGS. 3 and 4, a second preferred embodiment of the present invention is described. A bedding configuration 50 includes a mattress 52 and a box spring 54. The mattress 52 includes a fabric cover 56, an upper padding layer 58, a lower padding layer 60, and pocketed coils 62. One difference in the second preferred embodiment compared to the first preferred embodiment is the existence of sets of left and right side air cylinders 64, 66, respectively, positioned at the previously-identified middle or "lumbar" region of the mattress 52, best shown in FIG. 4.

Similar to the method discussed with respect to configuration 10, left- and right-side remote control units 68, 70, respectively, control the flow of air supplied by air pump 72 through corresponding air supply tubes 74 and manifolds 75. By means of manifold 75, each one of the two tubes 74 is attached to a respective set of air cylinders 64 or 66, such that the air pressure is substantially equal in each air cylinder in each set. Therefore it may be understood that a user may control the amount of air provided to the left or right-side air cylinder sets by using the corresponding remote control 68 or 70.

Third Preferred Embodiment

Figure 5:
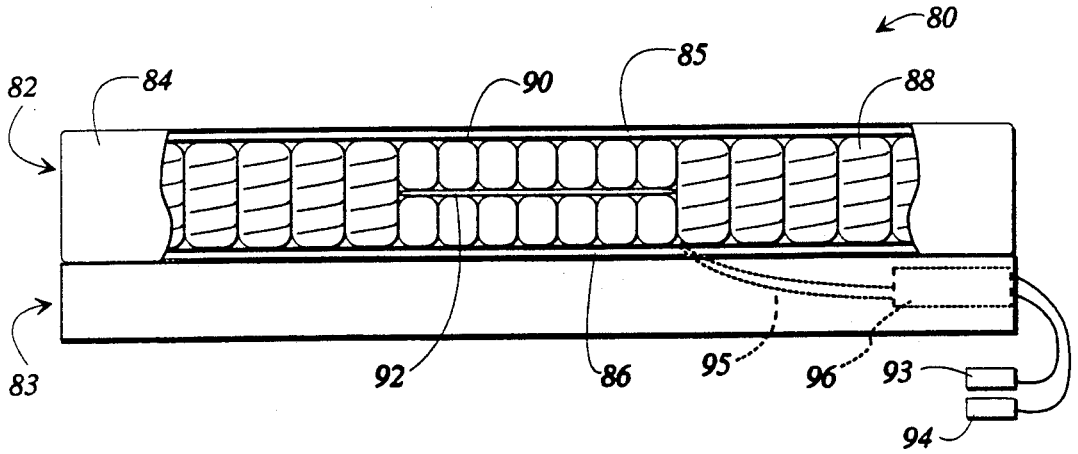
FIG. 5 a side plan view of a third preferred embodiment of the invention, with a portion of the mattress shown in partial cutaway, the air chamber shown deflated and various concealed elements shown in dotted line.
Figure 6:
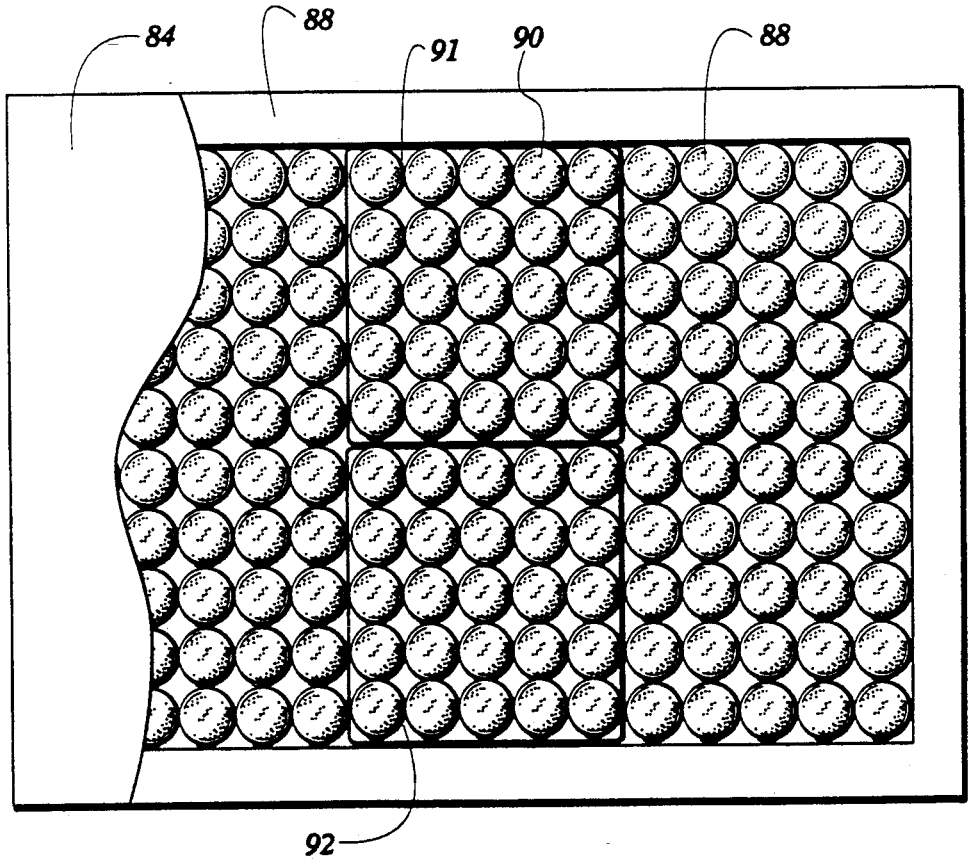
FIG. 6 is a top plan view of the mattress shown in FIG. 5, with a substantial portion of the fabric cover shown cut away to illustrate the interior features of the mattress.

Referring now to FIGS. 5 and 6, a third preferred embodiment of the present invention will be discussed. A bedding system 80 is similar to the previously-discussed bedding systems, in that it includes a mattress 82 and box spring 83, with the mattress 82 including a fabric cover 84, upper and lower padding layers 85, 86, respectively, and pocketed coils 88. However, the third embodiment differs in that half-size pocketed coils 90 are used to "sandwich" left- and right-side chambers 91, 92.

The box spring unit 83 includes elements similar to those previously discussed, including an air pump 96, left- and right-side remote control units 93, 94 respectively and a pair of air supply tubes 95. Similar to the previous configurations, the left- and right-side remote control units are used to control the air pump 96 such that air may be inserted into or withdrawn from corresponding left- and right-side air chambers 91, 92 respectively.

Figure 7:
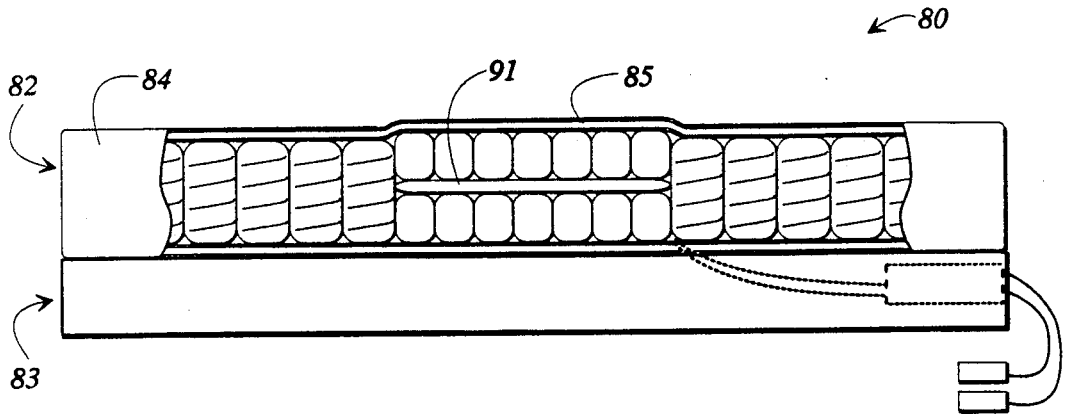
FIG. 7 is a side plan view of the third preferred embodiment of the invention as illustrated in FIG. 5, with the air chamber being illustrated as inflated.

Referring now to FIGS. 5 and 7, the inflation of the left side air chamber 91 is illustrated. It may be seen that as the air chamber 91 is inflated from the configuration shown in FIG. 5 to FIG. 7, it upwardly displaces the upper layer of half-size coils, such that the upper padding layer 85 is likewise displaced. It should be therefore understood that as the air chamber 91 is inflated, the central or "lumbar" portion of the mattress will feel firmer in the configuration as shown in FIG. 7 than in the configuration shown in FIG. 5.

Fourth Preferred Embodiment

Figure 8:
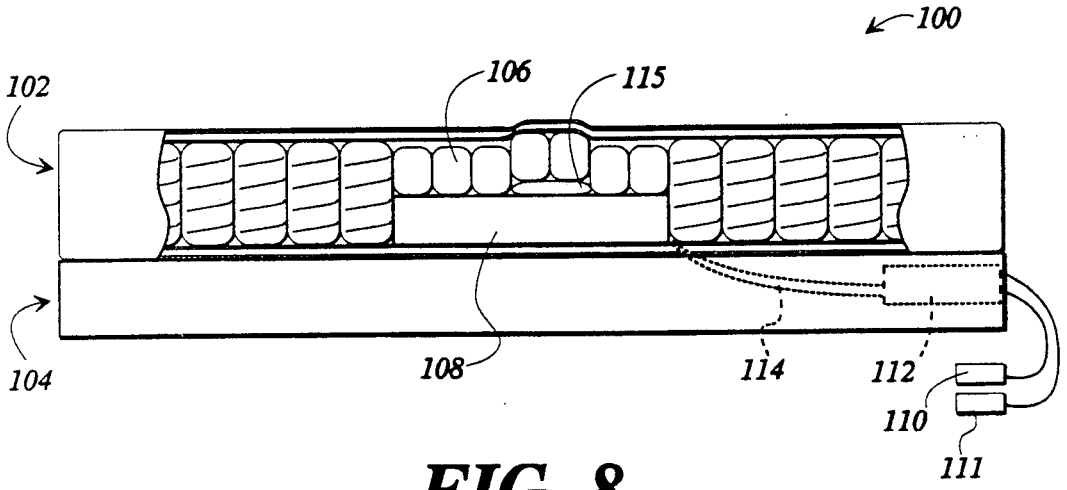
FIG. 8 is a side plan view of a fourth preferred embodiment of the invention, with a portion of the mattress shown in partial cutaway, and various concealed elements shown in dotted line.

Referring now to FIG. 8, a fourth preferred embodiment 100 is illustrated. Bedding system 100 includes a mattress 102, a box spring 104, and fabric layers, padding layers, full-size coil springs, and air control features similar to those described above. However, the fourth embodiment differs in that it includes a layer of half-size pocketed coils 106 and a right-side air chamber 108 and a left-side air chamber (not shown), with the half-size coils 106 positioned atop both the air chambers. Similar to the other configurations, each of these chambers may be independently controlled through corresponding remote control units 110, 111, as they control the flow of air from the air pump 112 through the tubes 114.

A lumbar support member 115 spans the mattress side-to-side in a transverse manner, and is positioned atop both the air chambers but underneath the layer of half-size pocketed coils 106, such that the half-size pocketed coils exhibit a slight upward bulge at approximately the area at which the small of the user's back will be situated when lying on his or her back. This bulge will allow the small of the user's back to "fit" to the contour of the supporting surface of the mattress such that the small of the back is better supported compared to conventional mattresses. It should be understood that this member 115 could be utilized in other of the concurrently-described embodiments of the invention without departing from the spirit and scope of the present invention. For example, such a contour member could be placed between the air chambers and one or both of the padding layers in the first preferred embodiment. It should of course be understood that, in order to provide a "symmetrical" mattress configuration as described below, two contour members would have to be used.

With respect to the fourth preferred embodiment, it may be understood that this particular embodiment 110 is not "symmetrical" about a horizontal plane intersecting the center of the mattress, as in the previously-described mattresses 12, 52, and 82. Symmetric mattress configurations may in many cases be desirable, as it is often desired to periodically flip mattresses over during their operating lives in order to insure longer wear characteristics. However, any perceived difference between the "feel" of the chamber versus the half-size pocketed coils may be minimized by selectively increasing the thickness or firmness of the padding layers, allowing inversion of the mattress with a minimum a perceived difference in the feel of the mattress. However, it may not be necessary to flip such mattress configurations over, as often the main reason for the need to make such inversions is due to excessive wear in the center of the mattress, which may be avoided by the novel configurations provided by the present invention. Finally, the thickness of the padding layers be instead be reduced in order to exploit the difference in feel of the air chambers versus the pocketed coils, as a user may consider it advantageous to invert the mattress as desired to suit his or her bedding preference at a given time.

Fifth Preferred Embodiment

Figure 10:
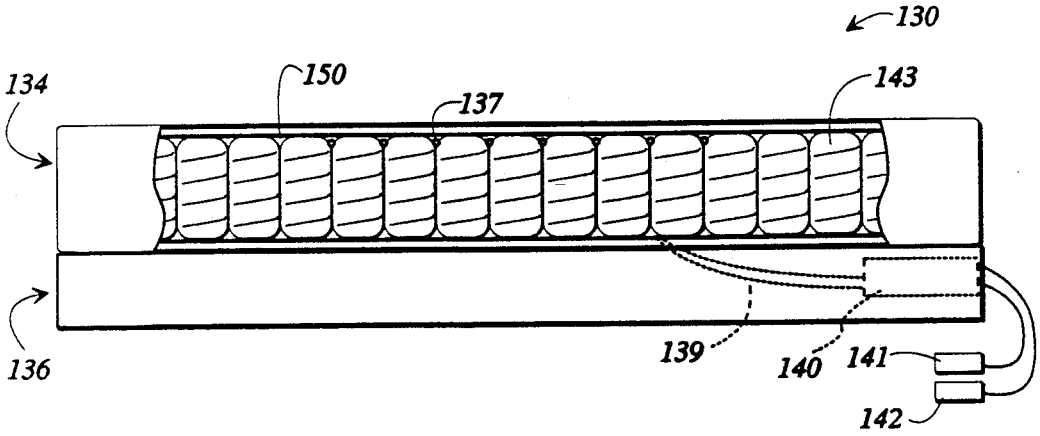
FIG. 10 a side plan view of a fifth preferred embodiment of the invention, with a portion of the mattress shown in partial cutaway along line 10-10 of FIG. 11 such that some of the serpentine air tubes are shown in cross-section, and various concealed elements being shown in dotted line.
Figure 11:
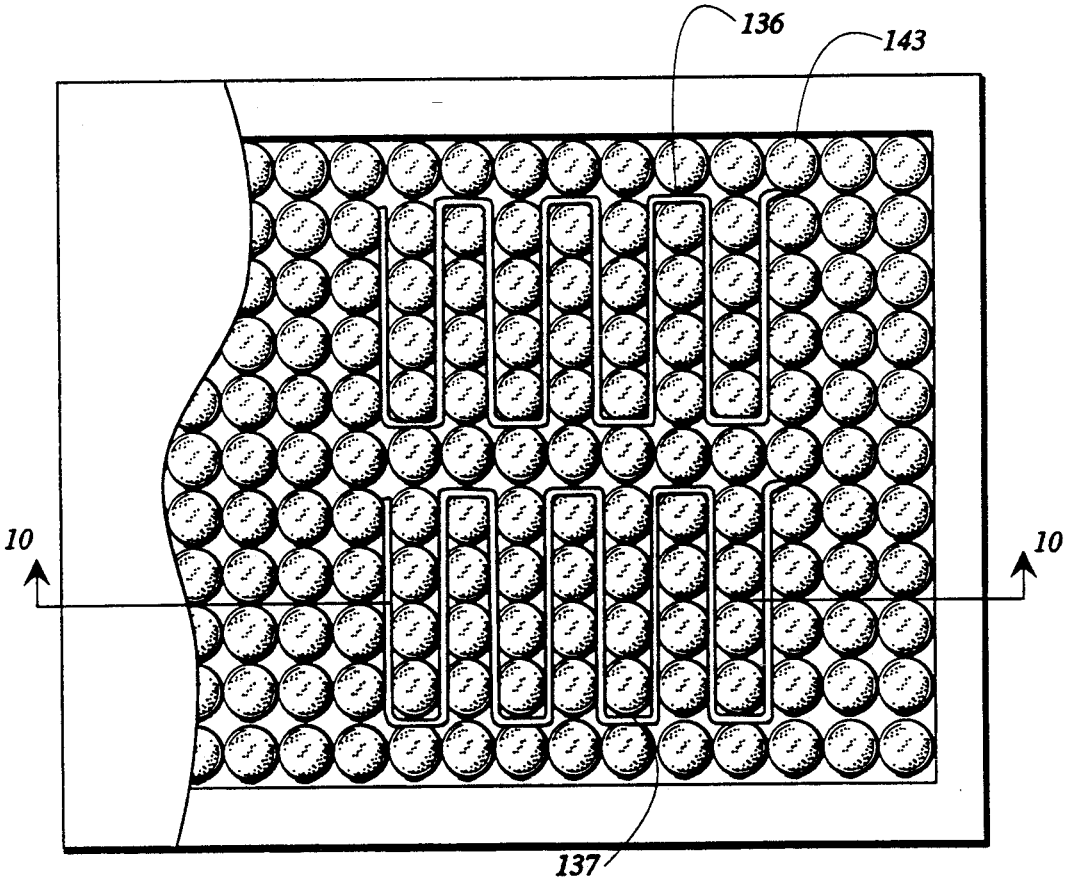
FIG. 11 is a top plan view of the mattress shown in FIG. 10, with a substantial portion of the fabric cover shown cut away to illustrate the interior features of the mattress.

Referring now to FIGS. 10 and 11, a fifth preferred embodiment is illustrated. Bedding system 130 includes a mattress 132, a box spring 134. The innerspring portion of the mattress 132 is similar to that illustrated in U.S. Pat. No. 4,578,834. However, the innerspring portion includes left and right supports inflatable/deflatable air tubes 136, 137, respectively, which are positioned in a serpentine configuration within the pocketed springs 135 at the lumbar area of the mattress as illustrated in the drawings. The air tubes 136, 137, are closed at one end, and supplied with air at the other end by means of air supply lines 139, themselves connected to air pump 140 controlled by left and right remote control units 141, 142, similar to the systems previously discussed. The air tubes extend through a hole in the mattress cover, and thread their way through the interior of the mattress to reach the tubes 136, 137. It should be understood that this method of placing the tubes in the mattress may also be used in the other embodiments.

It may be understood that when the pocketed coils 143 are placed in an adjacent side-to-side position as shown in the drawings, the "barrel" shape of the pocketed coils 143 facilitates a gap 150 at the top and bottom of the coils. This allows the left and right side air tubes 136, 137, to be nestled in the gaps 150 between the pocketed coils 143 and under the padding layer 145. As the coils are positioned in what may be understood as substantially straight rows and columns, it may be seen that the tubes may be easily situated in place by running them in between rows or columns of the adjacent pocketed coils for various lengths. If it may be understood that "columns" of coils runs lengthwise along the mattress and "rows" of coils run perpendicular to the columns of coils, the air tubes of the fourth preferred embodiment may be seen to run in between two rows of four coils each, then turn at a right angle to run in between columns of one coil each, and then turn at a right angle again to run in between two rows of four coils each, with this pattern repeating for a number of times. Other serpentine or non-serpentine configurations may also be used without departing from the spirit and scope of the present invention.

As the air tubes are inflated, they tend to increase the firmness of the mattress 132 by filling their respective gaps 150 and restricting the deflection per unit load of the coils 143. Conversely, as the tubes are deflated, the firmness tends to decrease. The tubes may be configured of latex rubber in order to stretch somewhat during inflation, but may also be configured of a pliant but relatively nonstretchable material such as vinyl.

It should be understood that although the preferred embodiment does contemplate use of the serpentine tubes only in the lumber region of the mattress, other positionings could be used without departing from the spirit and scope of the present invention. For example, the serpentine tubes could be used throughout the length of the mattress. Furthermore, more than two side-by-side tubes could be used in each mattress. Finally, the tubes could be placed on both sides of the mattress.

Variations From Preferred Embodiments

It should be understood that many alterations may be provided to the preferred embodiments without departing from the spirit and scope of the present invention. For example, a rigid foundation could be used in place of a box spring. Vibrating means known in the art could be attached to the mattress of box spring (or foundation) to provide the desired effect. Single air chambers could be used instead of dual chambers. Water could be used instead of air.

Air control means (not shown) could also be provided with a feedback feature which would also a user to "select" a desired air pressure (and corresponding firmness) or a particular chamber, whether of not the chamber is supporting a heavy user, a light user, or no user at all.

Plastic coils could be used instead of pocketed coils, such as the plastic coils described in U.S. Pat. No. 4,895,352, entitled "Matress or Cushion Spring Array", hereby incorporated by reference. Extruded plastic spring elements such as those described in U.S. Pat. No. 4,895,352, could also be used in either the mattress or the box springs described above.

Finally, portions of extruded high performance plastic components could be used in either the mattresses or box springs. If used in box springs, the plastic components could be configured to "snap" onto a wire grid, which could itself be positioned atop a perimeter of conventional open coils such that the plastic components fit within the perimeter of open coils. Use of such plastic components will reduce squeaking inherent in many metal spring configurations, which will result in greater customer satisfaction.

Conclusion

Therefore, it may be seen that the present invention provides an improvement over the prior art, as it provides a improved supporting surface at the center or "lumbar" region of the mattress, while avoiding undesirable effects of full-length chambers. The present invention also provides an improvement over the prior art by providing a personalized air control system which allows a user to choose, at any time, a selected firmness for each side of the bed by simply operating a remote control device. This adjustability feature is an important part of the invention, as it may be seen that infinite adjustability within a particular range may be achieved by use of suitable air pumps and flow control valves.

The present invention also provides the general desirable characteristics of pocketed coils or similar conventional configurations at the head or foot regions, while providing improved wear characteristics and firmness control at the center or "lumbar" portion of the mattress. Finally, the nature of the air containers situated within the lumbar area, typically the first area to fail due to repeated wear or "setting" of conventional coil springs, encourages longer life for the mattress, resulting in user satisfaction not only due to the longer life of the mattress but also due to a reduced need to invert or "flip" the mattress.

While this invention has been described in specific detail with particular reference to the disclosed embodiments, it will be understood that many variations and modifications may be effected within the spirit and scope of the invention as described in the appended claims.

What is claimed is:

1. An innerspring construction, comprising:

a plurality of barrel-shaped pocketed coils comprising a first row and having substantially parallel longitudinal axes;

a plurality of barrel-shaped pocketed coils comprising a second row and having substantially parallel longitudinal axes, said second row being adjacent to said first row such that the longitudinal axes of said second row pocketed coils are substantially parallel to said longitudinal axes of said first row pocketed coils and top and bottom elongate gaps are provided intermediate said rows at the tops and bottoms of said pocketed coils; and an inflatable elongate tube portion positioned within said top gap.

2. An innerspring construction as claimed in claim 1, further comprising a top padding layer positioned atop all of said pocketed coils and adjacent to said elongate tube portion.

3. An innerspring construction as claimed in claim 2, further comprising means for inflating said tube.

4. An innerspring construction as claimed in claim 1, further comprising means for inflating said tube.

5. A mattress configuration comprising:

a head region;

a foot region;

a center region itself comprising;

a) a plurality of barrel-shaped pocketed coils comprising a first row and having substantially parallel longitudinal axes:

b) a plurality of barrel-shaped pocketed coils comprising a second row and having substantially parallel longitudinal axes, said second row being adjacent to said first row such that the longitudinal axes of said second row pocketed coils are substantially parallel to said longitudinal axes of said first row pocketed coils and top and bottom elongate gaps are provided intermediate the rows at the tops and bottoms of the pocketed coils; and c) an inflatable elongate tube portion positioned within said top gap; and means for inflating said tube portion.

6. An innerspring construction as claimed in claim 5, further comprising a top padding layer positioned atop all of said pocketed coils and adjacent to said elongate tube portion.

7. An innerspring construction, comprising:

at least three barrel-shaped pocketed coils comprising a first row and having substantially parallel longitudinal axes;

at least three barrel-shaped pocketed coils comprising a second row and having substantially parallel longitudinal axes, said second row being adjacent to said first row such that the longitudinal axes of said second row pocketed coils are substantially parallel to said longitudinal axes of said first row pocketed coils and first top and bottom gaps are provided intermediate the rows at the tops and bottoms of said pocketed coils, and second top and bottom gaps are provided intermediate the second and third pocketed coils of said second row of pocketed coils; and an inflatable elongate tube portion positioned within said first top gap and also positioned within said second top gap, such that said elongate tube portion includes a bend.

8. An innerspring construction as claimed in claim 7, further comprising means for inflating said tube.

9. An innerspring construction as claimed in claim 7, further comprising a top padding layer positioned atop all of said pocketed coils and adjacent to said elongate tube portion.

10. An innerspring construction as claimed in claim 9, further comprising means for inflating said tube.

* * * * *